United States Patent [19]

Faull

[11] 4,372,606

[45] Feb. 8, 1983

[54] ROCKER STRUCTURE FOR ROCKING CHAIRS

[76] Inventor: James K. Faull, Rte. #1, Box 156, Enon Valley, Pa. 16120

[21] Appl. No.: 191,866

[22] Filed: Sep. 29, 1980

[51] Int. Cl.[3] ..... A47C 3/02

[52] U.S. Cl. ..... 297/265; 297/258; 297/313

[58] Field of Search ..... 5/104; 297/261, 263, 297/313, 262, 264, 265, 266, 267, 269, 349

[56] References Cited

U.S. PATENT DOCUMENTS

| | | | |
|---|---|---|---|
| 130,554 | 8/1872 | Wiggers | 297/261 X |
| 201,087 | 3/1878 | Beierdorf | 297/264 |
| 365,288 | 6/1887 | Wicker | 297/266 |
| 2,648,579 | 8/1953 | Slyter et al. | 297/349 X |
| 3,053,570 | 9/1962 | Fox | 297/263 |
| 4,183,494 | 6/1980 | Cleveland | 297/264 X |

FOREIGN PATENT DOCUMENTS

| | | | |
|---|---|---|---|
| 203724 | 10/1908 | Fed. Rep. of Germany | 5/104 |
| 2031111 | 12/1971 | Fed. Rep. of Germany | 297/265 |
| 7872 | 4/1894 | United Kingdom | 5/104 |

*Primary Examiner*—James T. McCall
*Attorney, Agent, or Firm*—Michael Williams

[57] ABSTRACT

A simple, inexpensive rocker construction for a rocking chair comprising a pair of vertically-spaced, horizontally-disposed plates, the upper of which is adapted for securement to the undersurface of the seat of a rocking chair, and the lower of which is adapted to have swivel connection with a disc to which the supporting legs are attached. A pair of tubular posts are disposed vertically between the plates to provide a sweeping rocking action for the chair. Sturdy coil springs are connected between the plates to hold the latter assembled with the posts and to urge the chair to a normal position it would occupy if no one were sitting in the chair.

7 Claims, 7 Drawing Figures

ROCKER STRUCTURE FOR ROCKING CHAIRS

BACKGROUND AND SUMMARY

The prior art contains many patents relating to rocking mechanisms for rocking chairs, but such prior mechanisms are either unstable, such as when only coil springs are interposed between the base and seat portions of a rocking chair; or such mechanisms are costly to manufacture and provide a stiff rocking action, such as when side marginal portions of spaced metal plates are riveted together; or are costly to manufacture and noisy in operation, such as when side marginal portions of spaced metal plates rock on each other, and such cost and noise are not materially reduced when the rocking portions are made of a non-metal.

My invention provides a simple rocker mechanism that may be mass-produced at a low cost in respect to both material and labor. The improved rocker structure comprises a pair of metal plates that are formed in a conventional stamping operation. The plates are arranged in spaced overlying relation, and the upper plate is adapted to be secured to the rocker seat while the lower plate has swivel connection with a disc to which the floor engaging legs are attached.

Disposed between the plates is a pair of rocker members, in the form of metal rods or tubes, and opposite ends of each rod or tube have connections with respective tubes to provide a sweeping rocking action of the chair. Coil springs are connected between the plates to hold them and the rocking rods or tubes assembled, and to perform the function of yieldably opposing rocking action.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

Figure 1:
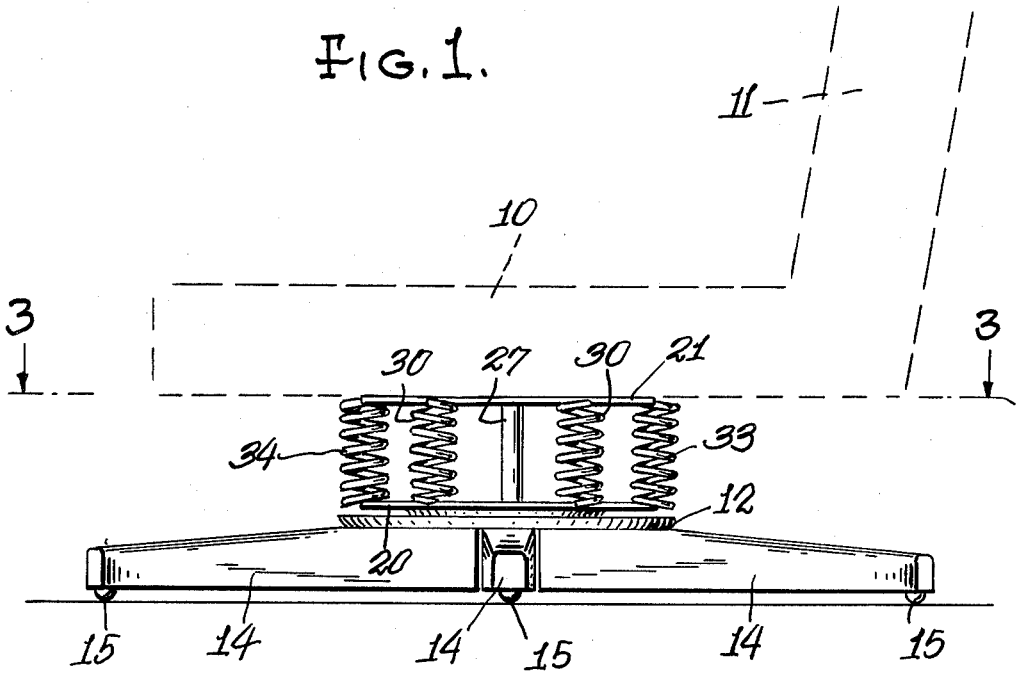
FIG. 1 is a side elevational view of my improved rocker spring structure, the chair which it supports being shown in dot-dash lines in a normal position.

The rocker to which my improved structure is attached may take various forms, for use both in the home and in industry. A seat 10 and back 11 of a chair are shown in dotted lines in FIGS. 1 and 2, the seat having a usual rigid undersurface to receive attaching screws or bolts 9 (see FIG. 3) to hold the rocker structure to the chair in position to support the same.

The rocker structure comprises a metal disc 12 to which the chair legs 14 are firmly secured, such as by bolting, welding or integral formation. The disc 12 is shown as of circular shape, although any other shape may be utilized, so long as there are no protruding sharp corners into which a person may kick his foot.

The legs 14 are shown as radiating from the center of the disc 12 and are of any desired number. In the drawing, five legs are shown and this number is preferred since it is believed that legs in that number provide maximum stability. The legs may have glider buttons 15 attached thereto, for sliding over the floor surface, although conventional wheels may be used in place of the glider buttons.

The disc 12 is formed of steel sheet of a gauge heavy enough to support the chair and the person occupying the latter, and yet light enough so that it may be blanked and formed in normal stamping operations. Sixteen gauge, or slightly heavier sheet, has been found suitable for the purpose. In some cases it may be treated to resist corrosion.

The disc 12 is formed to provide concentric depressed inner and outer portions 16 and 17 to provide a central flat portion 18 and a flat circular band 19 between the portions 16 and 17. The disc 12 provides a swivel support for parts which provide for the rocking action and, as seen in the drawing, such parts include a pair of metal plates 20 and 21, which may be formed of the same steel as the disc 12.

The plates are disposed horizontally and in vertically-spaced, overlying relation, with the lower plate 20 in juxtaposed relation with the disc 12. The plates may take any suitable shape and in the disclosed embodiment are rectangular in shape and of the same dimensions. The plate 20 is blanked and formed to provide a flat central portion 22 and a circular land 23 complementary to the parts 16 and 19 of the disc 12. The shank 24 of a stud passes through aligned central holes in the central portions 18 and 22 and opposite ends of the stud have heads 25 to hold the disc 12 and lower plate together, but free to rotate relative to each other. A washer **25*a* is preferably disposed between portions 18 and 22**.

Disposed between the confronting surfaces of the circular lands 19 and 23 is a bearing disc 26 of a low-friction material. The construction provides a low-friction swivel, generally along the lines shown in U.S. Pat. No. 3,574,427, issued to me on Apr. 12, 1971. The upper plate 21 is shown as formed similar to the lower plate, as a matter of manufacturing convenience, although this upper plate need not have the bearing lands and, if desired, may be merely blanked to a flat formation.

Figure 3:
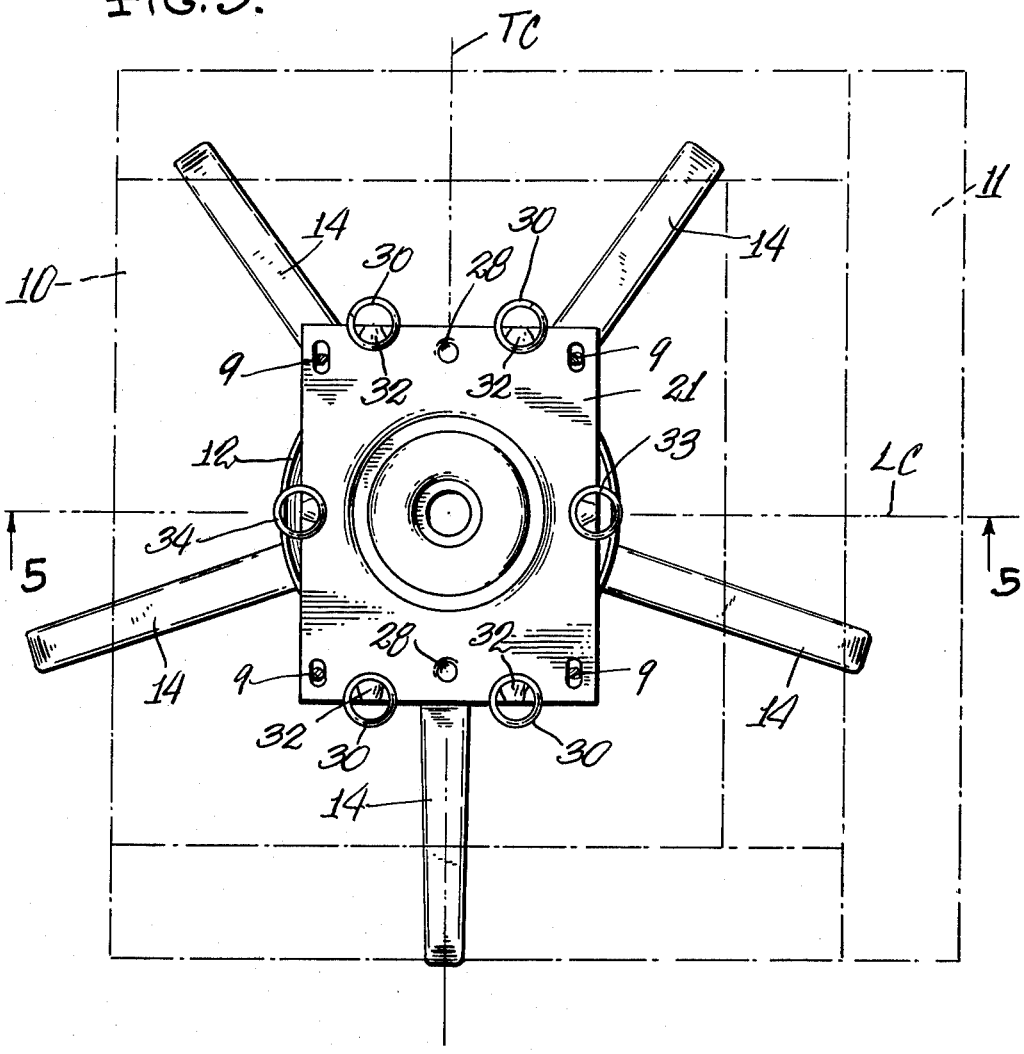
FIG. 3 is a sectional view corresponding to the line 3—3 of FIG. 1.

Pivot members are disposed between the plates 20 and 21 to hold these plates in spaced relation and to permit the upper plate to rock relative to the lower plate. These members take the form of rigid posts between the plates with opposite ends engaging the plates for rocking action. As seen in FIG. 3 the preferred embodiment utilizes two posts disposed on opposite sides of the longitudinal centerline LC of the chair, and equidistantly of this centerline and along a transverse centerline TC.

Figure 4:
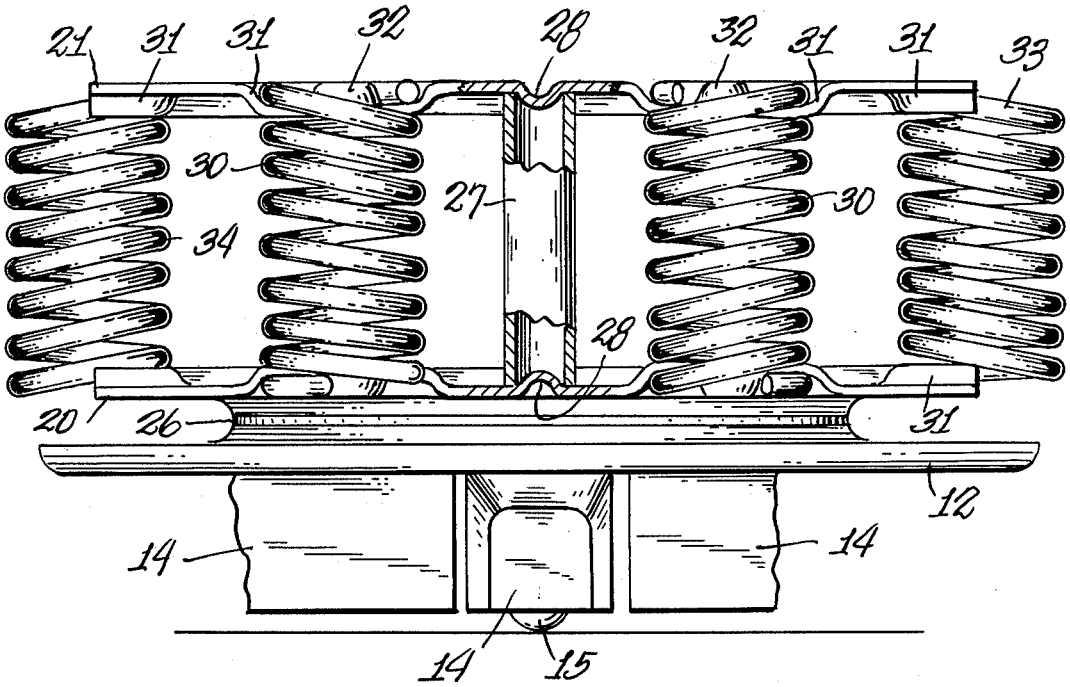
FIG. 4 is an enlarged side elevational view of my improved rocker spring structure with parts in section.
Figure 5:
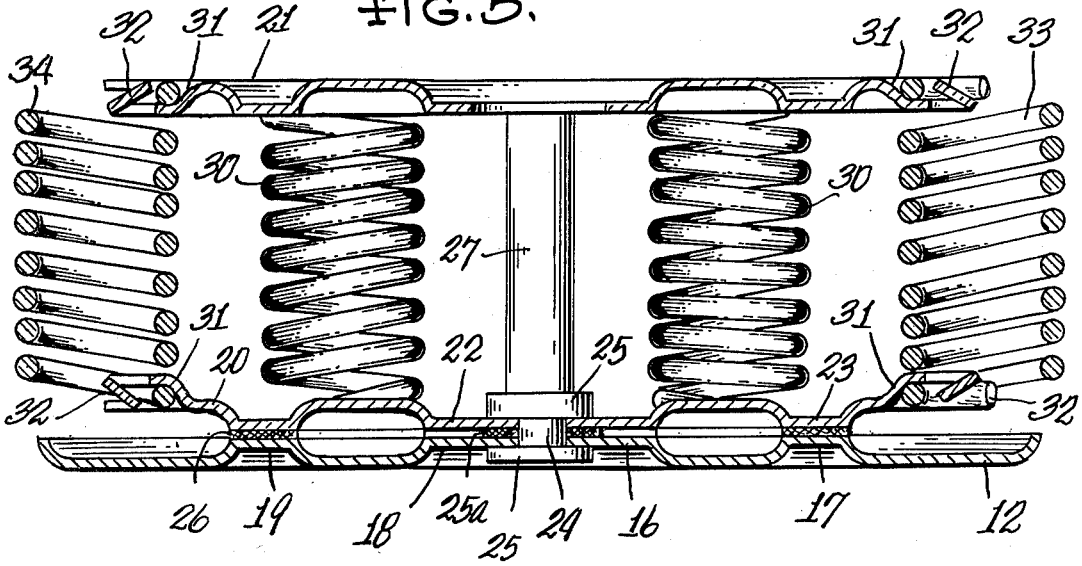
FIG. 5 is an enlarged sectional view corresponding generally to the line 5—5 of FIG. 3, and FIGS. 6 and 7 are fragmentary sectional views showing alternate construction.

Each of the posts is preferably in the form of a metal tube 27 of about five-eights inches (15.875 millimeters) outside diameter. Each of the plates 20,21 has inwardly-formed dimples 28 (see FIG. 4) to fit within a respective end of a tube 27, to provide for rocking movement of the upper plate. A comparison of FIG. 1 with FIG. 2 will show that this rocking movement has sort of a sweep as the chair is rocked rearwardly by an individual, and this rocking movement is about a horizontal transverse axis which passes through the bottom of the tubes 27 and the corresponding abutments 28. A similar sweeping rock is developed when the chair is rocked forwardly. The chair may not be rocked from side to side and this is preferred for reasons of stability. If the chair is to be rocked along the axis TC, the user need only swivel the chair so that the axis LC is in the position formerly occupied by the axis TC.

In order to prevent uncontrolled rocking action about the tubes 27, springs are provided to provide a cushioned sweep back and forth. As seen in the drawings, pairs of coil springs 30–30 are connected between the plates 20 and 21 on opposite sides of each tube 27 preferably equidistant of the axis of the latter.

At the point of connection with a coil spring 30, each plate has a semicircular, inwardly-displaced area 31 located at its margin, each inwardly-displaced area providing a central anchor projection 32. Convolutions at opposite ends of each coil spring are seated within respective inwardly-displaced areas 31 with the anchor projection 32 fitting within the end convolution to restrict displacement of the coil spring. This type of spring anchorage, and the method of assemblying the springs with the plates, are shown in U.S. Pat. No. 3,840,205, issued to me on Oct. 8, 1974. The springs 30 are tensioned between the plates 20,21 to urge the same in a direction toward each other and against opposite ends of each tube 27.

In some instances the coil springs 30 are sufficient to prevent uncontrolled rocking movement of the chair but, in the interest of safety, comfort and stability, it is preferred to install a coil spring 33 between the plates 20,21 at the rear side of the rocker device and, in many cases, a similar coil spring 34 at the front side of the rocker device. The springs 33 and 34 are disposed midway of the tubes 27,27 as seen in FIG. 3.

Figure 2:
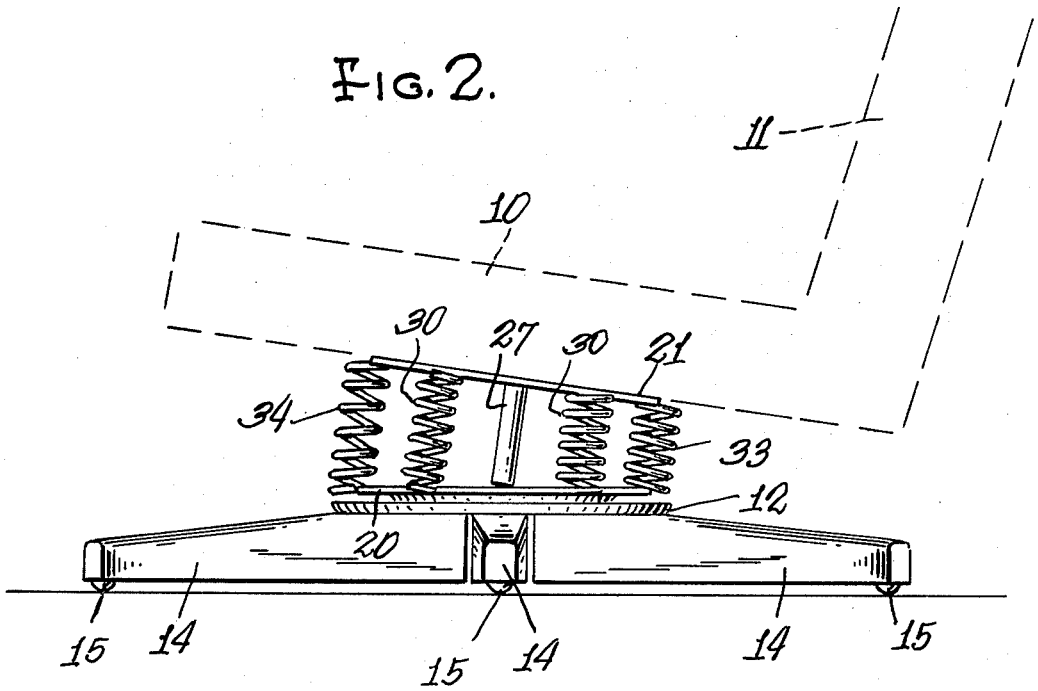
FIG. 2 is a view similar to FIG. 1 but showing the parts in position as if a person had rocked backward.

As the chair is moved from the normal position shown in FIG. 1 to a rearward position shown in FIG. 2, it will be noted that the tubes 27 tilt rearwardly about the rocking connection with the lower plate 20, the rocking connection with the upper plate permitting such tilting action. It will be also noted that the coil springs 30 and 33 at the rear of the tubes 27 will be compressed whereas the coil springs 30 and 34 at the front of the tubes 27 will be stretched. This will generate compression and tension forces which operate to gently urge the chair to its normal position shown in FIG. 1 when the weight of the person sitting in the chair no longer causes rearward swinging of the chair. It will be appreciated that a reverse of the foregoing will take place when the chair is tilted forwardly.

Figure 6:
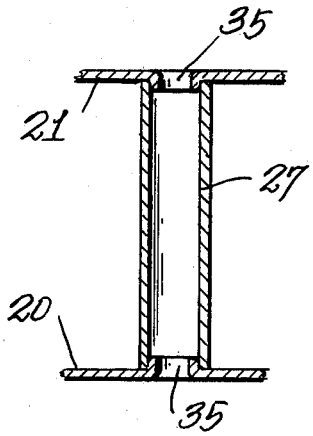

FIG. 6 shows an alternative form of connection between the plates 20,21 and the tube 27. In this embodiment each plate is formed with a short circular neck 35 which fits within the adjoining end of the tube 27.

Figure 7:
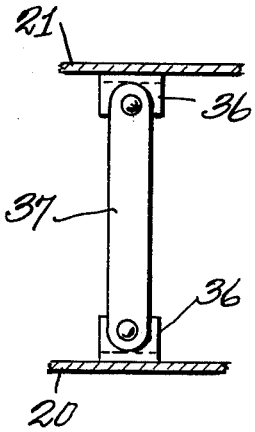

FIG. 7 shows a further alternate form of connection between the plates 20,21 and the tube 22. In this embodiment a right-angled lug 36 is secured to each plate and the tube is replaced by a link 37 which has pivot connections wth the lugs.

I claim:

1. A rocking structure for a chair, comprising:

a pair of generally horizontally-disposed rigid plates, one spaced vertically above and in line with the other, the upper plate being adapted for connection to the seat of the chair, said plates having corresponding opposite side margins, and corresponding front and rear margins which, when said upper plate is connected to the chair seat, face the front and rear of the chair, means connected to the lower plate and including legs for supporting the chair from a floor surface, a pair of rigid posts extending transversely between said plates, each post disposed inwardly of a respective one of the opposite side margins of said plates, and each post having its upper and lower ends engaging respective facing surfaces of said upper and lower plates at a localized place intermediate the length of a respective side margin in a manner to provide rocking movement of said upper plate relative to said lower plate and in turn provide for rocking movement of the chair seat in a direction from the front to the rear and vice versa, and a pair of coil springs disposed on opposite sides of each post in line with the rocking movement of said upper plate, said springs drawing said plates toward each other and yieldably opposing rocking movement of said chair seat.

2. The construction according to claim 1 wherein a coil spring is disposed between and has its opposite ends connected to said plates at the front margins thereof.

3. The construction according to claim 2 wherein a coil spring is disposed between and has its opposite ends connected to said plates at the rear margins thereof.

4. The construction according to claim 1 wherein each post is in the form of a metal tube, the facing surfaces of said upper and lower plates having abutments which fit within respective opposite open ends of said tubes.

5. The construction according to claim 4 wherein said abutments are inwardly displaced portions of said plates.

6. The construction according to claim 1 wherein said posts are in the form of links which have their opposite ends pivoted to respective plates.

7. The construction according to claim 1 wherein said lower plate forms part of a swivel structure to which said legs are connected.

* * * * *